US011440343B2

(12) United States Patent
Beckwith et al.

(10) Patent No.: US 11,440,343 B2
(45) Date of Patent: Sep. 13, 2022

(54) CHALK BOX WITH CHALK REEL SPOOL GROOVE

(71) Applicant: APEX BRANDS, INC., Apex, NC (US)

(72) Inventors: Jonathan Siebert Beckwith, Raleigh, NC (US); Cecil Wilson, Sanford, NC (US)

(73) Assignee: APEX BRANDS, INC., Apex, NC (US)

( * ) Notice: Subject to any disclaimer, the term of this patent is extended or adjusted under 35 U.S.C. 154(b) by 0 days.

(21) Appl. No.: 17/618,943

(22) PCT Filed: Jun. 11, 2020

(86) PCT No.: PCT/US2020/037177
§ 371 (c)(1),
(2) Date: Dec. 14, 2021

(87) PCT Pub. No.: WO2020/257039
PCT Pub. Date: Dec. 24, 2020

(65) Prior Publication Data

US 2022/0203757 A1 Jun. 30, 2022

Related U.S. Application Data

(60) Provisional application No. 62/862,212, filed on Jun. 17, 2019.

(51) Int. Cl.
*B44D 3/38* (2006.01)

(52) U.S. Cl.
CPC ..... *B44D 3/38* (2013.01)

(58) Field of Classification Search
CPC ..... B44D 3/38
See application file for complete search history.

(56) References Cited

U.S. PATENT DOCUMENTS 4,565,011 A 1/1986 Karger
4,765,557 A 8/1988 Kahmann
(Continued)

FOREIGN PATENT DOCUMENTS

CN 201228145 4/2009
CN 205219088 5/2016
(Continued)

OTHER PUBLICATIONS

International Search Report and Written Opinion from international application No. PCT/US20/37177 dated Oct. 8, 2020, all pages cited in its entirety.

(Continued)

*Primary Examiner* — Yaritza Guadalupe-McCall
(74) *Attorney, Agent, or Firm* — Burr & Forman LLP

(57) ABSTRACT

A spool for a chalk box may include a core member extending substantially parallel to an axis of rotation of the spool, a first sidewall disposed in a plane substantially perpendicular to the axis of rotation of the spool at a first end of the core member, and a second sidewall disposed in a plane substantially parallel to the first sidewall at a second end of the core member. The string may be configured to be retained on the spool by being wound onto the core member. The first sidewall may include a first anchorage orifice and a second anchorage orifice spaced apart from each other and each passing through the first sidewall from an inside surface of the first sidewall to an outside surface of the first sidewall. A spool groove may be formed on the outside surface of the first sidewall extending from the first anchorage orifice to the second anchorage orifice.

13 Claims, 8 Drawing Sheets

(56) References Cited

U.S. PATENT DOCUMENTS

| | | | | |
|---|---|---|---|---|
| 6,098,299 | A | 8/2000 | Collins et al. | |
| 6,199,785 | B1 * | 3/2001 | Paugh | B65H 75/4431 242/378.1 |
| 6,289,597 | B1 | 9/2001 | Beyers | |
| 6,745,485 | B2 * | 6/2004 | Shor | B44D 3/38 33/413 |
| 7,231,722 | B2 | 6/2007 | Hickey et al. | |
| 7,478,484 | B2 * | 1/2009 | Nepil | B44D 3/38 242/407 |
| 8,746,608 | B2 * | 6/2014 | Weissbrod | B23K 26/0846 242/476.6 |
| 9,701,154 | B2 * | 7/2017 | Parker | B44D 3/38 |
| 9,815,320 | B2 | 11/2017 | Khangar et al. | |
| 10,071,594 | B2 | 9/2018 | Chernyshou et al. | |
| 2008/0052935 | A1 | 3/2008 | Hanson et al. | |
| 2018/0244100 | A1 | 8/2018 | Usui et al. | |

FOREIGN PATENT DOCUMENTS

| | | | | |
|---|---|---|---|---|
| EP | 2455319 | A2 * | 5/2012 | B65H 75/4449 |
| WO | WO-2020257039 | A1 * | 12/2020 | B44D 3/38 |

OTHER PUBLICATIONS

Chinese Office Action dated Mar. 2, 2022 in Chinese Application No. 202080044186.4 filed Jun. 11, 2020.

* cited by examiner

FIG. 6A.
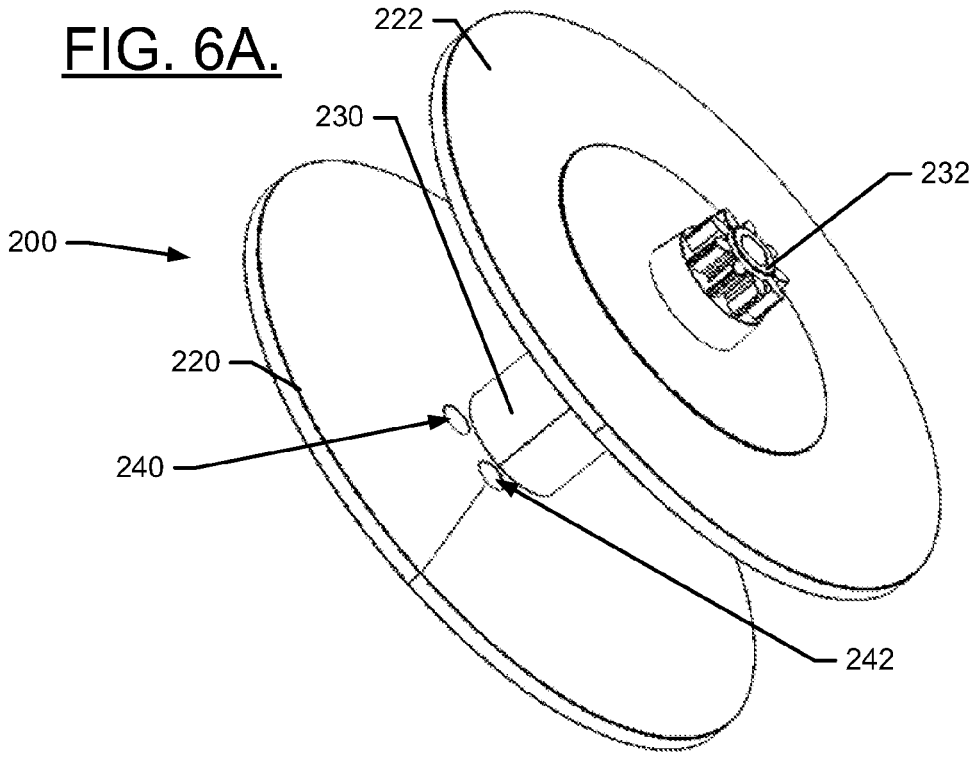
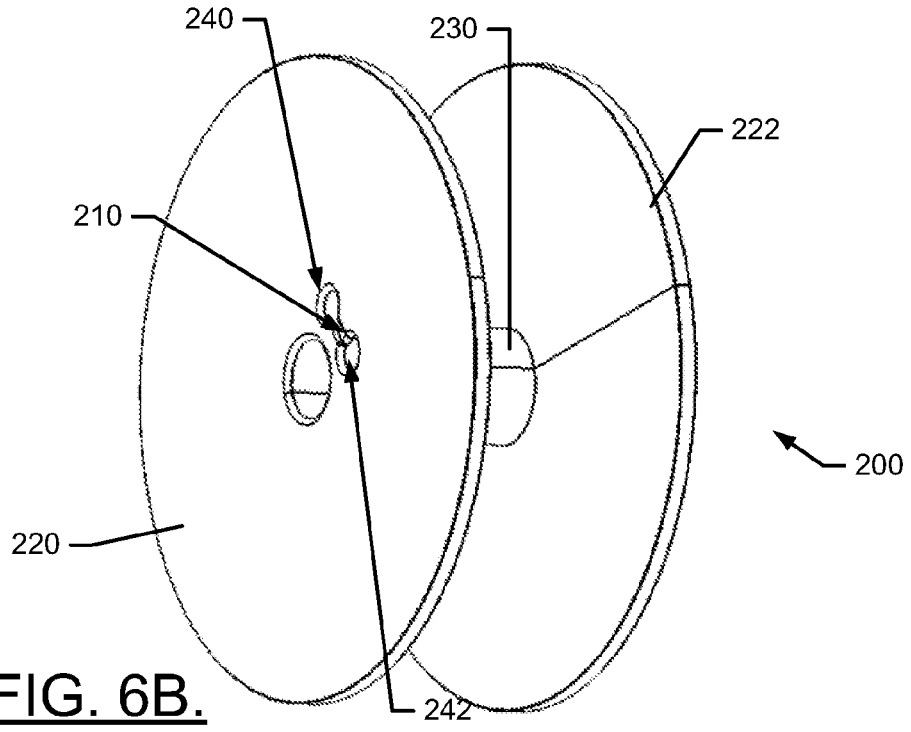
FIG. 6B.

CHALK BOX WITH CHALK REEL SPOOL GROOVE

TECHNICAL FIELD

Example embodiments generally relate to a chalk box or chalk reel, and more particularly relate to a chalk box or chalk reel having an improved spool design.

BACKGROUND

A chalk box (sometimes referred to as a chalk reel or chalk line tool) is a tool for marking straight lines on surfaces. To accomplish this, the chalk box typically includes a string or line that may be made of nylon, cotton or other materials and is able to be wound or spooled up onto a reel assembly. The string is exposed to chalk (or another marking substance) within the tool. The string typically has an end hook at one end, and the end hook extends from a body of the tool. The end hook can be pulled, thereby extracting string from the reel assembly, to place the end hook at a first point that is distant from a second point near which the remainder of the tool will be retained. Alternatively, the end hook could be affixed to the first point and the remainder of the tool can be moved to the second point while withdrawing string from the reel assembly. In either case, the end hook retains the string at the first point, and the user may pull the string relatively tightly to the second point (e.g., holding the string at the second point with the user's hand or thumb). The user may then pluck or snap the string sharply, and the chalk may be transferred to the surface to mark a straight line between the first and second points. The marked line is often referred to as a chalk line and, after its formation, the user often operates a rotatable handle that is operably coupled to the reel assembly to retract the string back onto the reel or drum thereof.

The process described above, and the tool adapted for performing the process, are both very old. Most chalk boxes utilize a spool that includes a set of openings cut in the side of the spool. The string is typically passed through this set of openings in order to allow the string to be tied to a portion of the spool for anchoring the string on the axis of the spool. By passing the string through one opening in the outward direction and then back through the other opening in the inward direction, not only is the string enabled to be tied for anchoring, but a portion of the string is then held against the outside of the spool. The diameter of the string now defines a minimum spacing that must be provided between the outer edge of the spool and any adjacent component of the housing or any other part of the chalk box. This minimum spacing requirement can impact the overall width (and therefore also the overall size) of the chalk box. In an age in which reducing part count, and reducing the size and/or weight of components without sacrificing performance is paramount, the typical design described above is clearly ripe for improvement.

BRIEF SUMMARY OF SOME EXAMPLES

Some example embodiments may enable the provision of a chalk box that has an improved spool design, which enables the chalk box to be made with optimized geometric characteristics. Furthermore, example embodiments may extend the useful life of the chalk box by preventing fraying or failing of the string at the location at which the string is anchored to the spool.

In an example embodiment, a chalk box (also known as a chalk reel or chalk line tool) is provided. The chalk box may include a housing having an aperture, a reel assembly enclosed within the housing, a string having a first end operably coupled to an end hook and configured to extend from the housing through the aperture and having a second end configured to be wound on the reel assembly, and a chalk reservoir in which the string is retained or through which the string passes prior to extending out of the aperture. The reel assembly may include a spool having a core member extending substantially parallel to an axis of rotation of the spool, a first sidewall disposed in a plane substantially perpendicular to the axis of rotation of the spool at a first end of the core member, and a second sidewall disposed in a plane substantially parallel to the first sidewall at a second end of the core member. The string may be configured to be retained on the spool by being wound onto the core member. The first sidewall may include a first anchorage orifice and a second anchorage orifice spaced apart from each other and each passing through the first sidewall from an inside surface of the first sidewall to an outside surface of the first sidewall. A spool groove may be formed on the outside surface of the first sidewall extending from the first anchorage orifice to the second anchorage orifice.

In another example embodiment, a spool for a chalk box may include a core member extending substantially parallel to an axis of rotation of the spool, a first sidewall disposed in a plane substantially perpendicular to the axis of rotation of the spool at a first end of the core member, and a second sidewall disposed in a plane substantially parallel to the first sidewall at a second end of the core member. The string may be configured to be retained on the spool by being wound onto the core member. The first sidewall may include a first anchorage orifice and a second anchorage orifice spaced apart from each other and each passing through the first sidewall from an inside surface of the first sidewall to an outside surface of the first sidewall. A spool groove may be formed on the outside surface of the first sidewall extending from the first anchorage orifice to the second anchorage orifice.

BRIEF DESCRIPTION OF THE SEVERAL VIEWS OF THE DRAWING(S)

Having thus described some example embodiments in general terms, reference will now be made to the accompanying drawings, which are not necessarily drawn to scale, and wherein:

FIG. 6A illustrates a perspective view showing an inside of the spool in accordance with an example embodiment;

FIG. 6B is a perspective view of the outside of the spool in accordance with an example embodiment;

DETAILED DESCRIPTION

Figure 2:
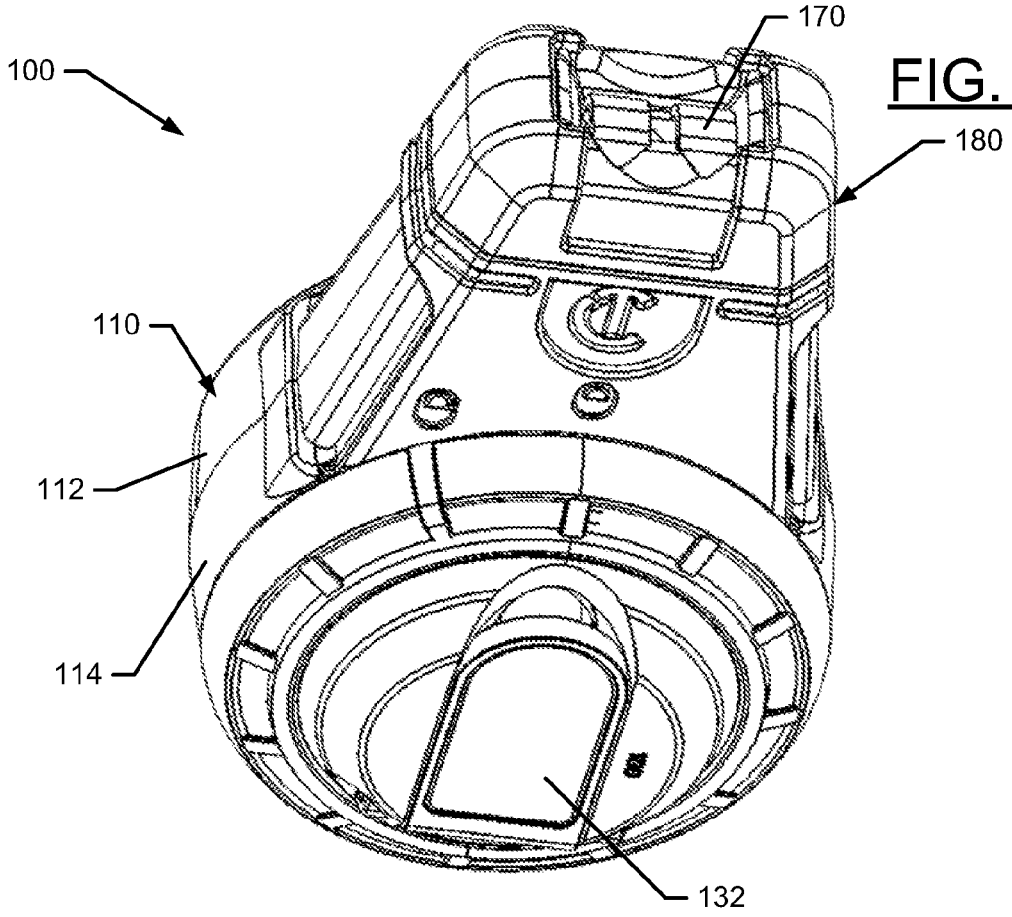
FIG. 2 illustrates a front perspective view of the chalk box in accordance with an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

Figure 1:
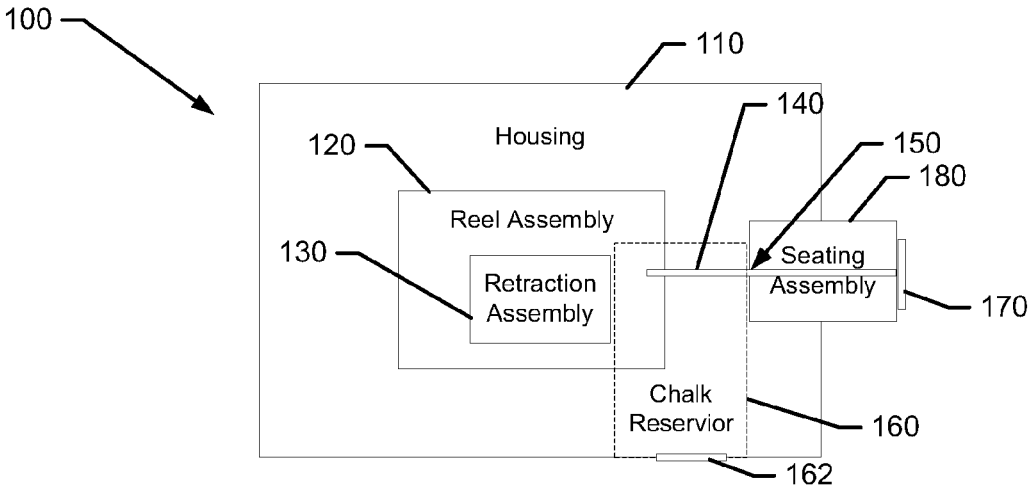
FIG. 1 illustrates a block diagram of a chalk box in accordance with an example embodiment.
Figure 3:
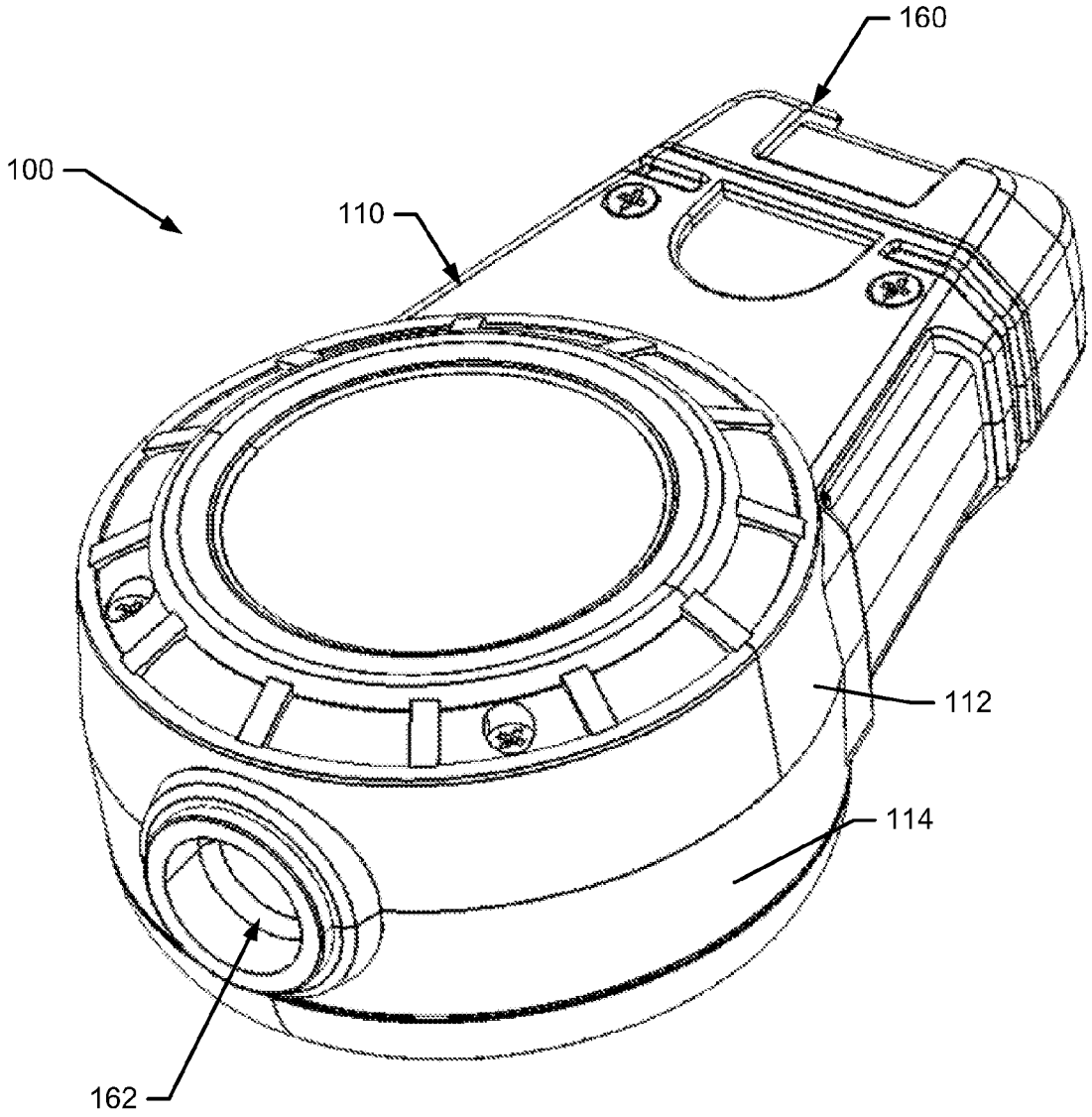
FIG. 3 illustrates a rear perspective view of the chalk box in accordance with an example embodiment.
Figure 4:
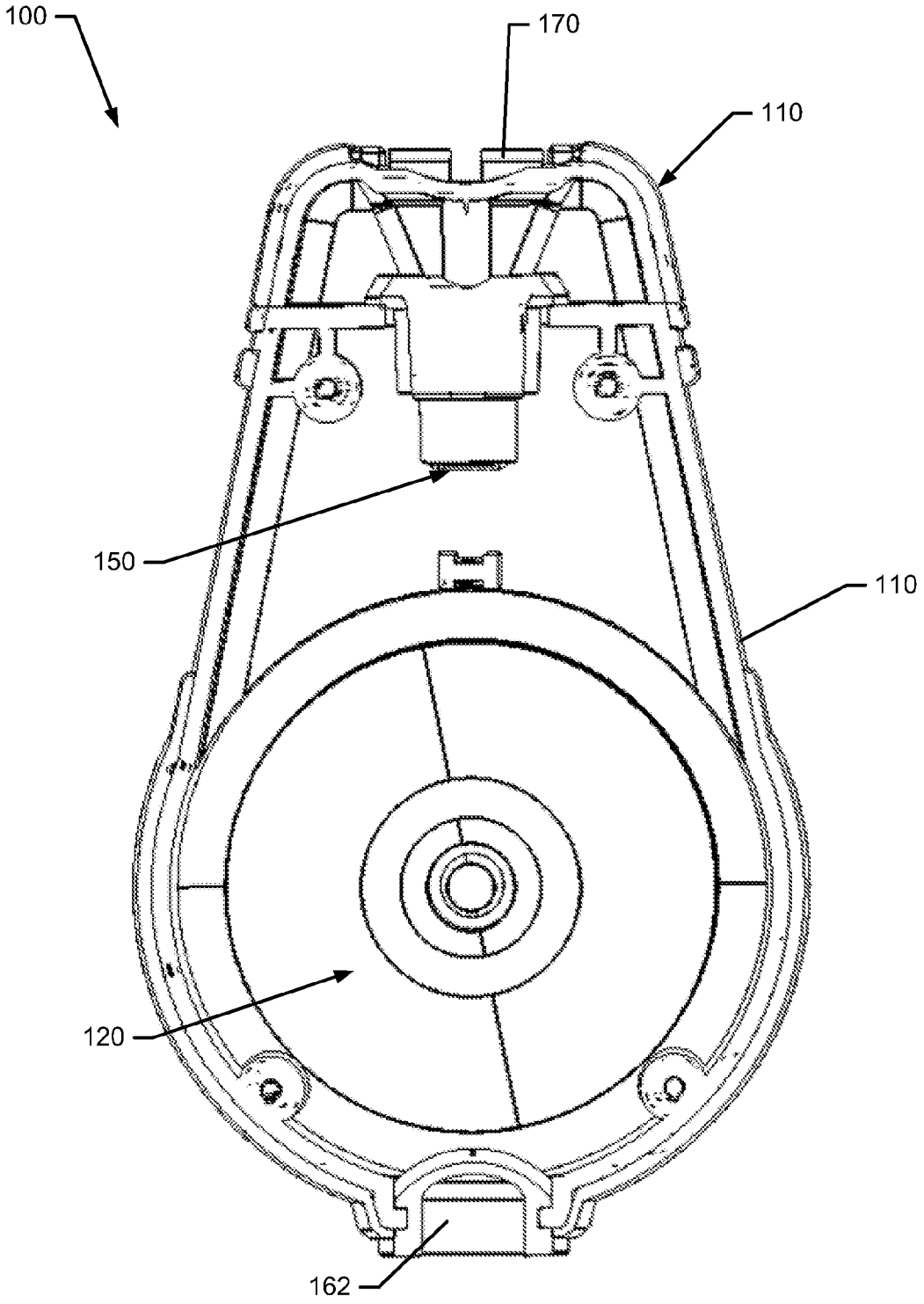
FIG. 4 illustrates a cross section view taken along a plane passing through the intersection between case halves of the chalk box in accordance with an example embodiment.
Figure 5:
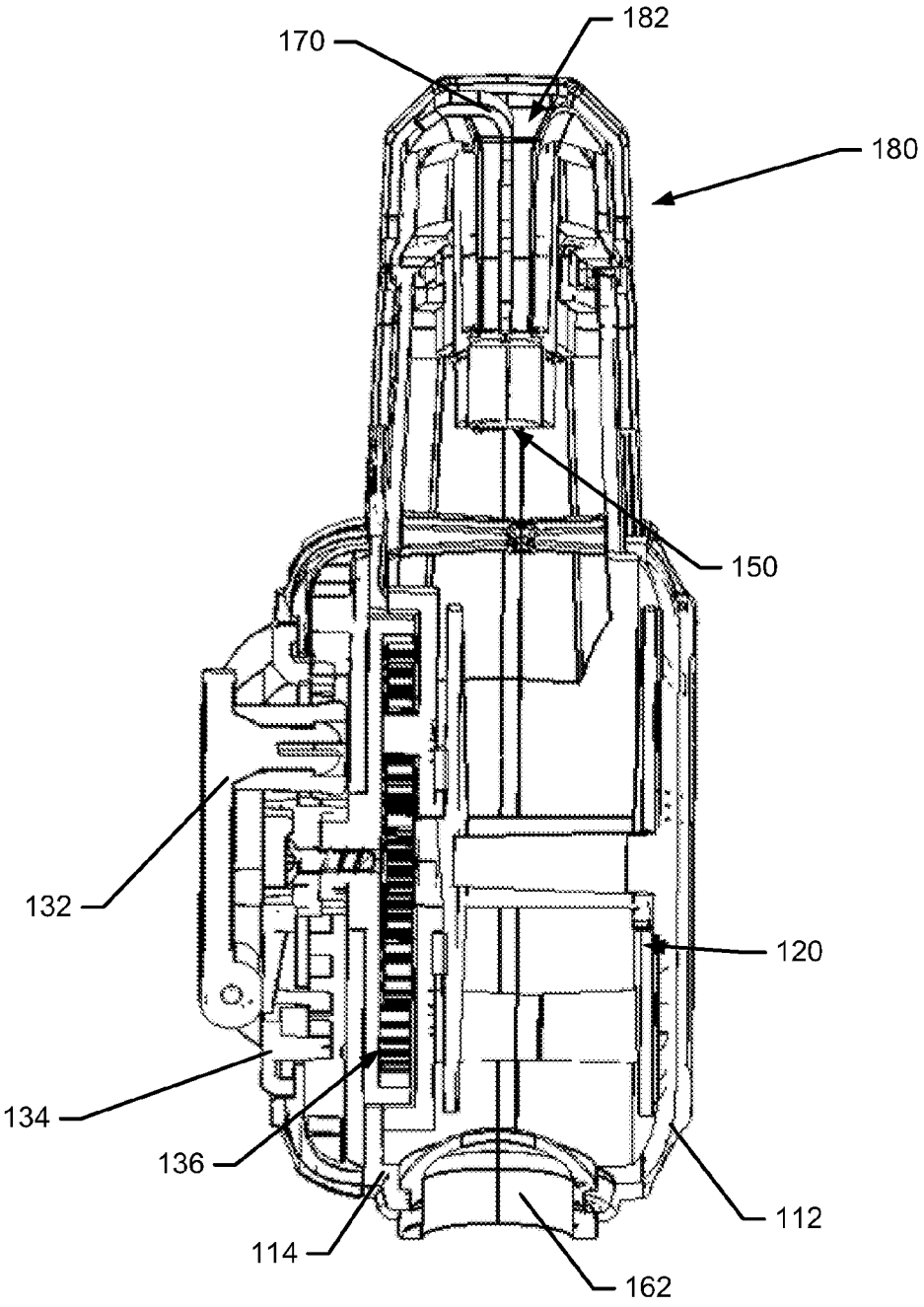
FIG. 5 is a cross section view taken along a longitudinal centerline of the chalk box via a plane that is perpendicular to the plane mentioned above in reference to FIG. 4 in accordance with an example embodiment.
Figure 6C:
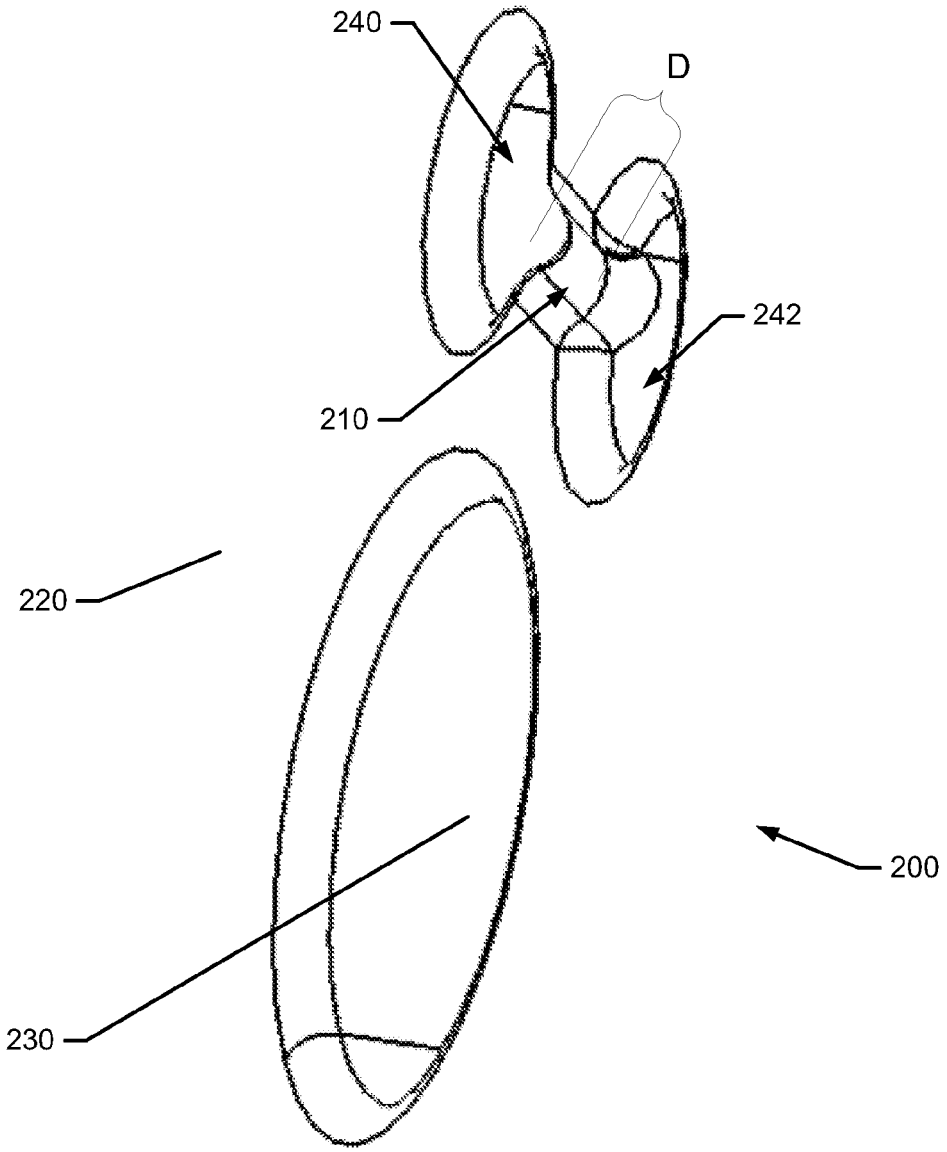
FIG. 6C is a closeup view of the spool groove of FIG. 6B in accordance with an example embodiment.
Figure 7:
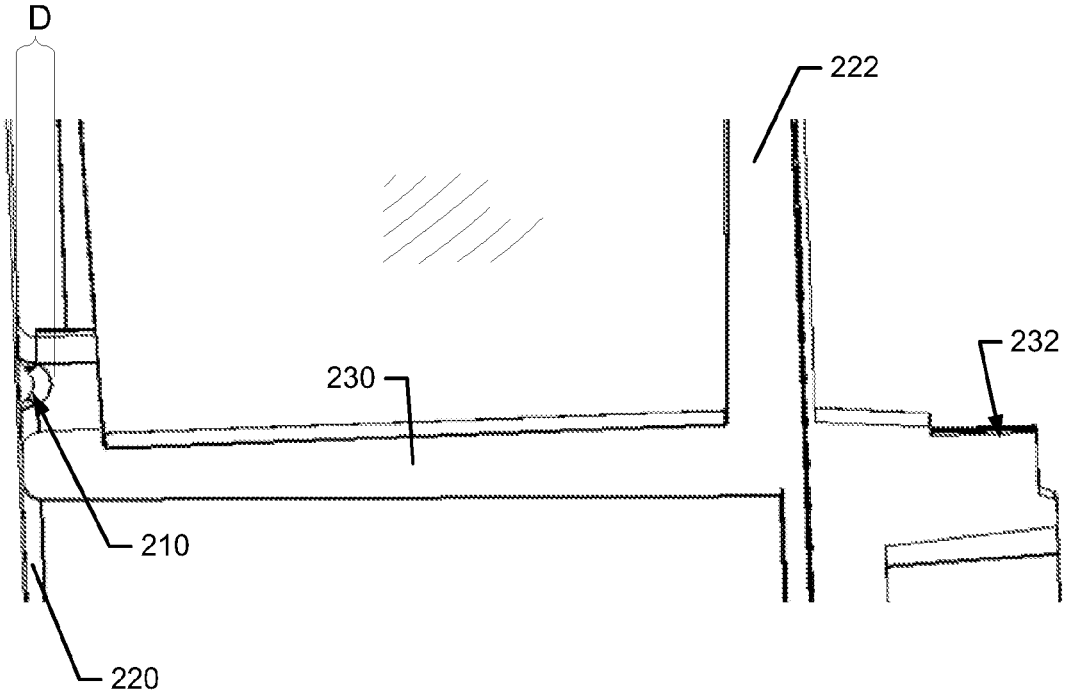
FIG. 7 illustrates a cross section view of the spool taken through a plane passing substantially perpendicular to a direction of extension of the spool groove in accordance with an example embodiment.
Figure 8:
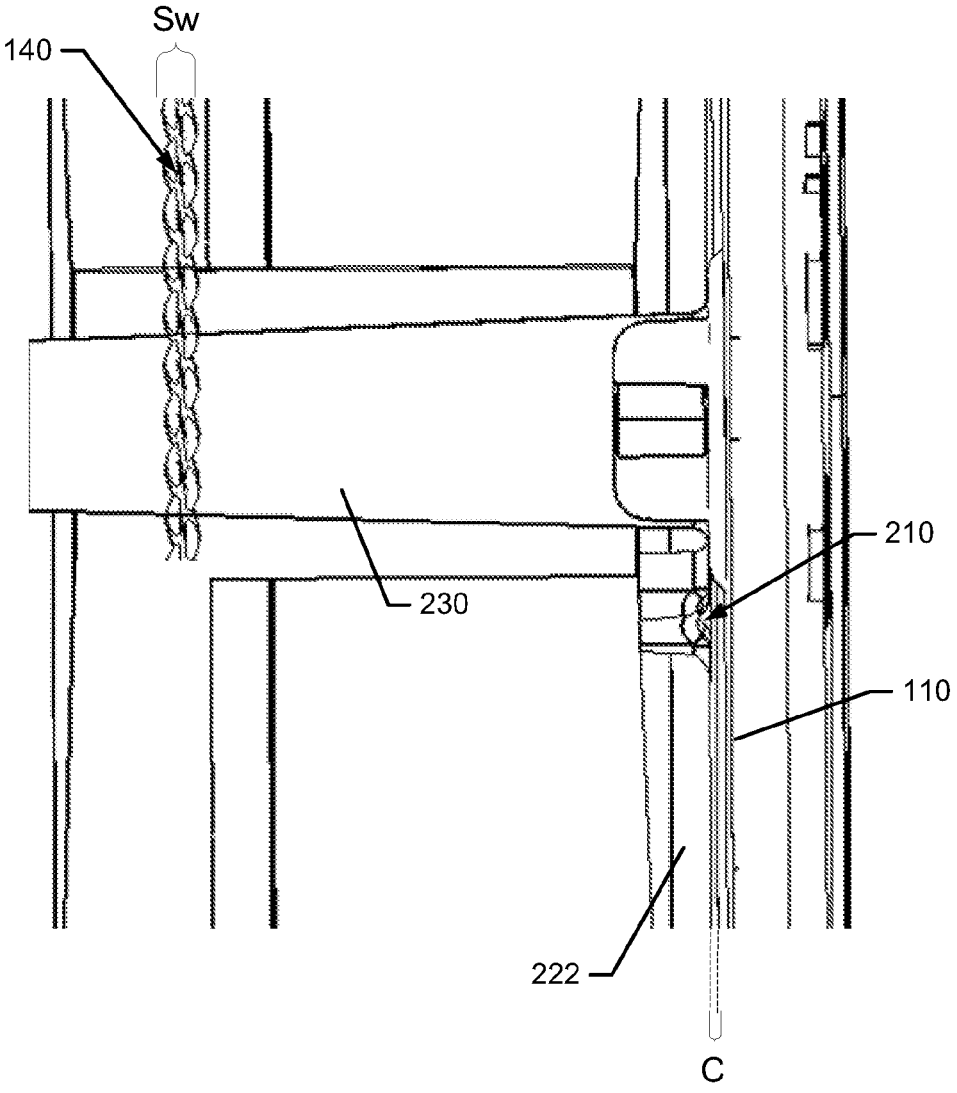
FIG. 8 illustrates a cross section view of the reel assembly showing clearance between the spool and the housing in accordance with an example embodiment.

As indicated above, some example embodiments may relate to the provision of a chalk box that may have an improved spool design for optimization of chalk box design geometries. FIG. 1 illustrates a block diagram of a chalk box 100 in accordance with an example embodiment, and FIGS. 2 and 3 illustrate front and rear perspective views, respectively, of the chalk box 100. FIG. 4 illustrates a cross section view taken along a plane passing through the intersection between case halves of the chalk box 100. FIG. 5 is a cross section view taken along a longitudinal centerline of the chalk box 100 via a plane that is perpendicular to the plane mentioned above in reference to FIG. 4. FIGS. 6-8 illustrates specific aspects of the improved spool design.

Of note, although FIGS. 2-5 illustrate a particular chalk box design that may work well with example spool designs, it should be appreciated that the spool design described herein can also be employed with any of a number of other chalk box designs. Thus, the chalk box design shown in FIGS. 2-5 is merely provided as an example to facilitate description of the operation of a chalk box generally, and to show how the spool design described herein can also be advantageously employed in one example chalk box design.

Referring now to FIGS. 1-5, the chalk box 100 of an example embodiment may include a housing 110 comprising a first case half 112 and a second case half 114. The first and second case halves 112 and 114 may house a reel assembly 120 and a retraction assembly 130 therein. A string 140 (or line) may be wound onto the reel assembly 120 and may be alternately withdrawn from and retracted back onto the reel assembly 120. The retraction back onto the reel assembly 120 may be accomplished via the retraction assembly 130, which may include a foldable handle 132 that is folded in to nest into a portion of the second case half 114, and folded out in order to enable the user to turn the handle 132. When the handle 132 is folded out and turned, a hub 134 rotates and is operably coupled to a gear assembly (see gear assembly 136 of FIG. 5) that may provide multiple rotations of a drum or reel of the reel assembly 120 for each respective rotation of the handle 132.

The string 140 may be paid out through an aperture 150 formed in a portion of the housing 110. The aperture 150 may be formed to be slightly larger than a diameter of the string 140, and may further house or retain a filter or wiping member, such as a piece of felt or other material that prevents excess escape of chalk from a chalk reservoir 160 that is exposed to the string 140 while the string 140 is inside the housing 110, and also removes excess chalk from the string 140 as the string 140 is withdrawn from the housing 110. The felt may be held in place by a retaining wire or other structure. The string 140 may therefore pass through or be retained in the chalk reservoir 160 before passing out the aperture 150. In an example embodiment, the chalk reservoir 160 may include a chalk port 162 that is accessible from outside the housing 110 to be removed to enable refilling of the chalk reservoir 160. The chalk port 162 of this example is located at a bottom portion of the housing 110, but other locations for the chalk port 162 are also possible.

The string 140 has an end hook 170 disposed at one end thereof, and is affixed to the reel assembly 120 at the other end of the string 140. The end hook 170 may be affixed (temporarily) to an anchor point on a medium or surface that is to be marked. Once the end hook 170 is affixed to the anchor point, the string 140 may be paid out of the aperture 150 and unwound from the reel assembly 120. When a desired length of the string 140 has been paid out, the user can make any necessary markings by snapping or plucking the string 140 as described above. The end hook 170 may then be released from the anchor point, and the handle 132 may be used to operate the retraction assembly 130 to wind the string 140 back onto the reel assembly 120 by drawing the string 140 back into the housing 110 via the aperture 150.

Although the end hook 170 may dangle from the housing 110 near the aperture 150, some example embodiments may employ a seating assembly 180, which may be formed as a mouth or nozzle that includes a reception cavity 182 that is formed therein to allow the end hook 170 to be withdrawn into the reception cavity 182. When the end hook 170 is withdrawn into the reception cavity 182, the end hook 170 may be seated flush with the distal end (relative to the remainder of the housing 110) of the seating assembly 180. In other words, the end hook 170 is fully seated in a portion of the housing 110 (specifically in the reception cavity 182 of the seating assembly 180) such that substantially all of the body, back, base or spine of the end hook 170 is received or surrounded by the reception cavity 182 and only the teeth or prongs (which extend at about a 90 degree angle to the body, back, base or spine) are outside the reception cavity 182. This arrangement, if employed, may ensure that the end hook 170 cannot be inadvertently snagged or caught on objects, clothing and/or the like, but also creates a sleek and aesthetically pleasing appearance.

As can be appreciated from FIGS. 1-5, and as described above, the size of the chalk box 100 is ultimately dependent upon the sum of the sizes of its various components in light of the design considerations in play with respect to arranging the geometries of the various components. For the reel assembly 120, a spool 200 is a key component for determining the width or thickness of the chalk box 100. In this regard, the handle 132, the retraction assembly 130 and the reel assembly 120 combine to define the thickness of the chalk box 100 in the axial direction. The spool 200 is the largest component relative to determining a minimum thickness of the reel assembly 120. In this regard, the spool 200 may be bordered on one axial end by the retraction assembly 130, and may be bordered on the opposite axial end by the housing 110 or a portion thereof to which the spool 200 is rotatably mounted. Accordingly, the spool 200 must have a minimum clearance defined between the spool 200 and the inside wall or face of the housing 110 in order to allow the spool 200 to turn without interference.

As noted above, the minimum clearance is normally at least as large as the diameter of the string 140 since the string 140 passes alongside one of the walls of the spool 200 to be tied or anchored near the axis of the spool 200. To reduce the size of this minimum clearance, example embodiments may provide a spool groove 210 between the anchorage orifices that are formed in the sidewall of the spool 200 as shown in FIGS. 6-8. In this regard, FIG. 6 is defined by FIGS. 6A, 6B and 6C. FIG. 6A illustrates a perspective view showing an inside of the spool 200, and FIG. 6B is a perspective view of the outside of the spool 200. Meanwhile, FIG. 6C is a closeup view of the spool groove 210 of FIG. 6B. FIG. 7 illustrates a cross section view of the spool 200 taken through a plane passing substantially perpendicular to a direction of extension of the spool groove 210. FIG. 8 illustrates a cross section view of the reel assembly 120 showing clearance between the spool 200 and the housing 110.

Referring to FIGS. 6-8, the spool 200 may include a first sidewall 220 and a second sidewall 222 that may each be substantially plate shaped, circular and face each other from opposite sides of a core member 230 that extends parallel to the axis of rotation of the spool 200. The core member 230 may be operably coupled to a gear 232 that may turn responsive to operation of the gear assembly 136 of FIG. 5. The axis of rotation may extend substantially perpendicular to a plane in which the first sidewall 220 lies and a plane in which the second sidewall 222 lies.

The spool 200 may have a first anchorage orifice 240 formed in the first sidewall 220 at a portion thereof that is proximate to an intersection of the first sidewall 220 and the core member 230. The spool 200 may also include a second anchorage orifice 242 formed in the first sidewall 220 spaced apart from the first anchorage orifice 240 and also proximate to the intersection of the first sidewall 220 and the core member 230. Although not required, in some cases, the first and second anchorage orifices 240 and 242 may each be equidistant from the core member 230 and the axis of rotation of the spool 200. The spool groove 210 may be formed in an outer surface (i.e., outwardly facing surface) of the first sidewall 220 and extend from the first anchorage orifice 240 to the second anchorage orifice 242. In some cases, the spool groove 210 may extend to define a chord between the first and second anchorage orifices 240 and 242 where respective ends of the chord each define equal radial distances from the axis of rotation of the spool 200 to a center of a respective one of the first and second anchorage orifices 240 and 242.

The spool groove 210 could be formed by removing material to a certain depth (D) measured from an outer face of the first sidewall 220. However, as an alternative to material removal, the spool 200 could be molded to include the spool groove 210 as a depression, groove or valley that extends linearly from the first anchorage orifice 240 to the second anchorage orifice 242. In either case, the depth (D) may be selected relative to a known diameter or width of the string 140 (i.e., string width (Sw)). If the depth (D) of the spool groove 210 is equal to or greater than the string width (Sw), then the string width (Sw) may not impact a clearance distance (C) that must be provided between the outer surface of the first sidewall 220 and the inner surface of the housing 110 that faces the first sidewall 220. The clearance distance (C) may then be optimized to be a minimum distance required for smooth operation of the spool 200.

If the spool groove 210 is formed to have a depth (D) that is less than the string width (Sw), then the clearance distance (C) may be larger due to the need to accommodate for the extension of the string 140 into the space between the outer surface of the first sidewall 220 and the inner surface of the housing 110 that faces the first sidewall 220 to prevent wearing or binding of the string 140. However, any significant depth (D) that is provided for the spool groove 210 will necessarily enable forming of the clearance distance (C) to be less than the string width (Sw). Since forming the clearance distance (C) to be less than the string width (Sw) is not possible with conventional designs, the provision of the spool groove 210 provides an ability to make the clearance distance (C) reduced to a value equal to a diameter of the string 140 (i.e., string width (Sw)) minus depth (D) of the spool groove 210. Thus, C=Sw−D. The ability to provide the string 140 in a recessed groove formed in the outer surface of the first sidewall 220 therefore enables optimization of case geometry by enabling a reduction of the distance between the outer surface of the first sidewall 220 and the inner surface of the housing 110 that faces the first sidewall 220. This reduced clearance distance (D) may further enable the spool 200 to rotate with less wobble, and may also make it less likely that the string 140 can be frayed or damaged over time, so that failure of the string 140 at the tie point (i.e., where tied to the first sidewall 220 at the first and second anchorage orifices 240 and 242) is also less likely.

In an example embodiment, a chalk box is provided. The chalk box may include a housing having an aperture, a reel assembly enclosed within the housing, a string having a first end operably coupled to an end hook and configured to extend from the housing through the aperture and having a second end configured to be wound on the reel assembly, and a chalk reservoir in which the string is retained or through which the string passes prior to extending out of the aperture, and a chalk port of an example embodiment. The reel assembly may include a spool that may further include a core member extending substantially parallel to an axis of rotation of the spool, a first sidewall disposed in a plane substantially perpendicular to the axis of rotation of the spool at a first end of the core member, and a second sidewall disposed in a plane substantially parallel to the first sidewall at a second end of the core member. The string may be configured to be retained on the spool by being wound onto the core member. The first sidewall may include a first anchorage orifice and a second anchorage orifice spaced apart from each other and each passing through the first sidewall from an inside surface of the first sidewall to an outside surface of the first sidewall. A spool groove may be formed on the outside surface of the first sidewall extending from the first anchorage orifice to the second anchorage orifice.

In some embodiments, the features of the device described above may be augmented or modified, or additional features may be added. These augmentations, modifications and additions may be optional and may be provided in any combination. Thus, although some example modifications, augmentations and additions are listed below, it should be appreciated that any of the modifications, augmentations and additions could be implemented individually or in combination with one or more, or even all of the other modifications, augmentations and additions that are listed. As such, for example, a depth of the spool groove may be equal to or greater than a string width of the string. However, in some alternatives, the depth of the spool groove may be less than a string width of the string. In an example embodiment, the first sidewall faces an inside portion of the housing and is separated therefrom by a clearance distance, and the clearance distance may be greater than or equal to the string width minus the depth of the spool groove. In some cases, the first and second anchorage orifices may be disposed proximate to the core member, equidistant from the axis of rotation of the spool. In an example embodiment, the spool groove may extend to define a chord between the first and second anchorage orifices, and respective ends of the chord may each define equal radial distances from the axis of rotation of the spool to a center of a respective one of the first and second anchorage orifices. In some cases, the spool groove may be formed in the first sidewall during molding of the spool.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. A spool for a chalk box, the spool comprising:

a core member extending substantially parallel to an axis of rotation of the spool;

a first sidewall disposed in a plane substantially perpendicular to the axis of rotation of the spool at a first end of the core member; and a second sidewall disposed in a plane substantially parallel to the first sidewall at a second end of the core member, wherein string is configured to be retained on the spool by being wound onto the core member, wherein the first sidewall includes a first anchorage orifice and a second anchorage orifice spaced apart from each other and each passing through the first sidewall from an inside surface of the first sidewall to an outside surface of the first sidewall, and wherein a spool groove is formed on the outside surface of the first sidewall extending from the first anchorage orifice to the second anchorage orifice.

2. The spool of claim 1, wherein a depth of the spool groove is equal to or greater than a string width of the string.

3. The spool of claim 1, wherein a depth of the spool groove is less than a string width of the string.

4. The spool of claim 1, wherein the first and second anchorage orifices are disposed proximate to the core member, equidistant from the axis of rotation of the spool.

5. The spool of claim 4, wherein the spool groove extends to define a chord between the first and second anchorage orifices, and wherein respective ends of the chord each define equal radial distances from the axis of rotation of the spool to a center of a respective one of the first and second anchorage orifices.

6. The spool of claim 1, wherein the spool groove is formed in the first sidewall during molding of the spool.

7. A chalk box comprising:

a housing having an aperture;

a reel assembly enclosed within the housing;

a string having a first end operably coupled to an end hook and configured to extend from the housing through the aperture and having a second end configured to be wound on the reel assembly; and a chalk reservoir in which the string is retained or through which the string passes prior to extending out of the aperture, wherein the reel assembly comprises a spool comprising:

a core member extending substantially parallel to an axis of rotation of the spool;

a first sidewall disposed in a plane substantially perpendicular to the axis of rotation of the spool at a first end of the core member; and a second sidewall disposed in a plane substantially parallel to the first sidewall at a second end of the core member, wherein string is configured to be retained on the spool by being wound onto the core member, wherein the first sidewall includes a first anchorage orifice and a second anchorage orifice spaced apart from each other and each passing through the first sidewall from an inside surface of the first sidewall to an outside surface of the first sidewall, and wherein a spool groove is formed on the outside surface of the first sidewall extending from the first anchorage orifice to the second anchorage orifice.

8. The chalk box of claim 7, wherein a depth of the spool groove is equal to or greater than a string width of the string.

9. The chalk box of claim 7, wherein a depth of the spool groove is less than a string width of the string.

10. The chalk box of claim 9, wherein the first sidewall faces an inside portion of the housing and is separated therefrom by a clearance distance, and wherein the clearance distance is greater than or equal to the string width minus the depth of the spool groove.

11. The chalk box of claim 7, wherein the first and second anchorage orifices are disposed proximate to the core member, equidistant from the axis of rotation of the spool.

12. The chalk box of claim 11, wherein the spool groove extends to define a chord between the first and second anchorage orifices, and wherein respective ends of the chord each define equal radial distances from the axis of rotation of the spool to a center of a respective one of the first and second anchorage orifices.

13. The chalk box of claim 7, wherein the spool groove is formed in the first sidewall during molding of the spool.

* * * * *